US008754838B2

(12) United States Patent
Kwon et al.

(10) Patent No.: US 8,754,838 B2
(45) Date of Patent: Jun. 17, 2014

(54) DISCHARGE CIRCUIT AND DISPLAY DEVICE WITH THE SAME

(75) Inventors: Jong-Hyuk Kwon, Chungcheongbuk-do (KR); Tae-Kyoung Kang, Chungcheongbuk-do (KR); Kwon-Young Oh, Chungcheongbuk-do (KR)

(73) Assignee: MagnaChip Semiconductor, Ltd., Cheongju-si (KR)

( * ) Notice: Subject to any disclaimer, the term of this patent is extended or adjusted under 35 U.S.C. 154(b) by 1285 days.

(21) Appl. No.: 12/427,333

(22) Filed: Apr. 21, 2009

(65) Prior Publication Data

US 2009/0309824 A1 Dec. 17, 2009

(30) Foreign Application Priority Data

Jun. 11, 2008 (KR) ..... 10-2008-0054856

(51) Int. Cl.
*G09G 3/36* (2006.01)

(52) U.S. Cl.
USPC ..... 345/98

(58) Field of Classification Search
USPC ..... 345/98
See application file for complete search history.

(56) References Cited

U.S. PATENT DOCUMENTS

| | | | | |
|---|---|---|---|---|
| 2002/0080133 | A1* | 6/2002 | Eu | 345/212 |
| 2002/0175909 | A1* | 11/2002 | Matsumoto | 345/211 |
| 2005/0253832 | A1* | 11/2005 | Chung | 345/204 |
| 2007/0075750 | A1* | 4/2007 | Woo et al. | 327/77 |

FOREIGN PATENT DOCUMENTS

| | | | |
|---|---|---|---|
| CN | 101101385 | A | 1/2008 |
| JP | 2000-002866 | | 1/2000 |
| JP | 2006-189714 | | 7/2006 |
| JP | 2007-094016 | | 4/2007 |
| KR | 10-1998-039369 | A | 8/1998 |
| KR | 2002-0036026 | | 5/2002 |
| KR | 10-2005-0108754 | | 11/2005 |
| TW | 200604994 | A | 2/2006 |
| TW | 200809754 | | 2/2008 |

OTHER PUBLICATIONS

Chinese Office Action issued on Jul. 13, 2011, in counterpart Chinese Patent Application No. 200910146668.6 (14 pages including English translation thereof).
Japanese Office Action issued Oct. 16, 2012 in counterpart Japanese Patent Application No. 2009-133731 (3 pages, in Japanese).
Taiwanese Office Action issued Jan. 31, 2013 in counterpart Taiwanese Patent Application No. 098113550 (9 pages, in Taiwanese).
Korean Office Action issued on Jun. 3, 2013 in corresponding Korean Application No. 10-2010-0077418. (6 pages, in Korean).

* cited by examiner

*Primary Examiner* — Nicholas Lee
(74) *Attorney, Agent, or Firm* — NSIP Law

(57) ABSTRACT

A discharge circuit of a device including a drive circuit operating by an inputted negative voltage includes: a discharge unit connected between a first input terminal receiving the negative voltage and a second input terminal receiving a ground voltage, and configured to discharge the negative voltage to the ground voltage of the second input terminal in response to a control signal; and a control unit connected between the first input terminal and a third input terminal receiving an operation voltage corresponding to a normal operation mode and an abnormal operation mode of the drive circuit, and configured to generate the control signal in response to an operation signal for determining an operation state and a non-operation state in the normal operation mode of the drive circuit.

18 Claims, 6 Drawing Sheets

DISCHARGE CIRCUIT AND DISPLAY DEVICE WITH THE SAME

CROSS-REFERENCE TO RELATED APPLICATIONS

The present invention claims priority of Korean Patent Application No. 10-2008-0054856, filed with Korean Intellectual Property Office on Jun. 11, 2008, which is incorporated herein by reference.

BACKGROUND OF THE INVENTION

1. Field of the Invention

The present invention relates to a discharge circuit of a display device, and more particularly, to a discharge circuit which can discharge a gate off voltage of a liquid crystal display (LCD) at high speed.

2. Description of Related Art

Generally, a liquid crystal display (LCD) is a sort of Flat Panel Display (FPD), which displays images by using liquid crystals. Since the LCD is thinner and lighter than other FPDs, uses a low driving voltage and has low power consumption, it is widely used in portable computers and other portable devices.

FIG. 1 is a block diagram of a conventional LCD.

Referring to FIG. 1, the LCD includes a timing control circuit 101, a gate drive circuit 102, a source drive circuit 103, a gray scale voltage generation circuit 104, a liquid crystal panel 105, and a gate on/off voltage generation circuit 106.

The timing control circuit 101 receives red (R), green (G) and blue (B) color signals RGB, a horizontal sync signal HSYNC, a vertical sync signal VSYNC and a clock signal CLK, and generates a plurality of control signals for controlling operations of the gate drive circuit 102 and the source drive circuit 103.

The gate drive circuit 102 operates in response to the control signals inputted from the timing control circuit 101, and receives a gate on voltage VGH and a gate off voltage VGL from the gate on/off voltage generation circuit 106 to control an operation of the liquid crystal panel 105. The gate on/off voltages VGH and VGL are used for turning on/off a thin film transistor (TFT) included in the liquid crystal panel 105.

The source drive circuit 103 receives a gray scale voltage having a plurality of voltage levels from the gray scale voltage generation circuit 104 and transfers the gray scale voltage to the liquid crystal panel 105 in response to the control signals inputted from the timing control signal 101.

The liquid crystal panel 105 includes a plurality of gate lines G0 to Gn, where n and m are natural numbers, and a plurality of data lines D1 to Dm arranged perpendicular to the gate lines G0 to Gn. In addition, the liquid crystal panel 105 includes a plurality of pixels at intersections of the data lines D1 to Dm and the gate lines G0 to Gn.

Each of the pixels includes a TFT, a storage capacitor Cst, and a liquid crystal capacitor Cp. The TFTs have gates connected to the gate lines G0 to Gn, and the sources connected to the data lines D0 to Dm, respectively. Moreover, first terminals of the liquid crystal capacitors Cp and first terminals of the storage capacitors Cst are connected in parallel to drains of the TFTs. The other terminals of the liquid crystal capacitors Cp are connected to a common electrode, and the other terminals of the storage capacitors Cst are connected to a preceding gate line.

Generally, the TFTs serve as switching elements. When the TFT is turned on, the liquid crystal capacitor Cp is charged with a gray scale voltage applied from the gray scale voltage generation circuit 104 through the data line. When the TFT is in a turned-off state, it prevents leakage of the voltage charged in the liquid crystal capacitor Cp. A voltage required to turn on the TFT is referred to as the gate on voltage VGH, and a voltage required to turn off the TFT is referred to as the gate off voltage VGL.

The driving characteristics of the LCD of FIG. 1 will be described briefly.

Referring to FIG. 1, when the gate on voltage VGH is applied to a first-row gate line G1, all first-row TFTs TFT1 connected to the first-row gate line G1 are turned on. At this point, the gray scale voltages applied from the source drive circuit 103 through the data lines D1 to Dm are applied to the liquid crystal capacitors Cp1 and the storage capacitors Cst1 through the TFTs TFT1, respectively. Consequently, the liquid crystal capacitors Cp1 are charged with voltages corresponding to a voltage difference between the gray scale voltages and a common electrode voltage, and the storage capacitors Cst1 are charged with voltages corresponding to a voltage difference between the gray scale voltages and the gate off voltage VGL of a preceding gate line G0. Furthermore, storage capacitors Cst2 of a next row, which are connected to the first-row gate line G1, are also charged.

In this state, in case where an external power supply voltage is shut off due to external impulses or power failure so that the drive circuit of the liquid crystal panel 105 is abnormally stopped, a short time is taken until the charged voltage of the storage capacitor Cst and the charged voltage of the liquid crystal capacitor Cp are completely discharged. This is because the TFT is turned off by the shut-off of the power supply voltage so that its drain is floated, and thus the charged voltage of the storage capacitor Cst and the charged voltage of the liquid crystal capacitor Cp are naturally discharged. Accordingly, even though a user shuts off the power supply voltage, image sticking is generated by a gradual discharge.

The time taken to discharge electric charges may be long or short according to the gate voltage-channel current characteristic of the TFT. In the drive circuit of the liquid crystal panel, the gate off voltage VGL drops to 0 V (ground voltage level) in several tens milliseconds to several hundreds milliseconds after the external power supply voltage is shut off. The electric charges charged in the liquid crystal panel 105 are discharged from that point so that a screen becomes normally black or normally white.

In this way, in case where quid crystal panel 105, i.e., the drive circuit is turned off by the shut-off of the external power supply, the gate off voltage VGL must quickly be discharged to 0 V in order to prevent image sticking on the screen. According to the known methods, the gate off voltage VGL is discharged by using a resistor R disposed inside the drive circuit or a module external to the drive circuit, as illustrated in FIG. 2.

However, the typical methods using the resistor R as illustrated in FIG. 2 are much influenced by the resistance of the resistor R. For example, when the resistance of the resistor R is high, the discharge speed of the gate off voltage VGL becomes slower and thus image sticking occurs. On the other hand, when the resistance of the resistor R is low, the discharge speed of the gate off voltage VGL increases. However, in a normal state, an excessive leakage current flows from the gate off voltage VGL to the ground voltage terminal. Consequently, burdens are imposed on a booster circuit generating the gate off voltage VGL.

SUMMARY OF THE INVENTION

An embodiment of the present invention is directed to providing a discharge circuit which can prevent image sticking by discharging a gate off voltage being a negative voltage to a ground voltage level at high speed when an external voltage is shut off and is not applied to a display panel due to impulses or power failure or in a standby mode (a non-operation state mode where a drive circuit does not operate), and a display device including the discharge circuit.

In accordance with an aspect of the present invention, there is provided a discharge circuit of a device including a drive circuit operating based on an inputted negative voltage, the discharge circuit including: a discharge unit connected between a first input terminal receiving the negative voltage and a second input terminal receiving a ground voltage, and configured to discharge the negative voltage to the ground voltage of the second input terminal in response to a control signal; and a control unit connected between the first input terminal and a third input terminal receiving an operation voltage corresponding to a normal operation mode and an abnormal operation mode of the drive circuit, and configured to generate the control signal in response to an operation signal for determining an operation state and a non-operation state in the normal operation mode of the drive circuit.

In accordance with an aspect of the present invention, there is provided a display device, including: a display panel; a gate on/off voltage generation circuit configured to generate a gate on voltage and a gate off voltage to the display panel; and a discharge circuit configured to discharge the gate off voltage according to an operation mode of the display panel, wherein the discharge circuit includes: a discharge unit connected between a first input terminal receiving the gate off voltage and a second input terminal receiving a ground voltage, and configured to discharge the gate off voltage to the ground voltage of the second input terminal in response to a control signal; and a control unit connected between the first input terminal and a third input terminal receiving an operation voltage corresponding to a normal operation mode and an abnormal operation mode of the display panel, and configured to generate the control signal in response to an operation signal for determining an operation state and a non-operation state in the normal operation mode of the display panel.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

DESCRIPTION OF SPECIFIC EMBODIMENTS

The advantages, features and aspects of the invention will become apparent from the following description of the embodiments with reference to the accompanying drawings, which is set forth hereinafter. In the following description, a drive circuit, moreover, is described as a display panel, for example, a drive integrated chip (IC) driving a liquid crystal panel, but the present invention is not limited to this embodiment. The drive circuit includes all circuits that receive a negative voltage in operation, and may include at least one transistor and capacitor where the negative voltage is charged.

Figure 4:
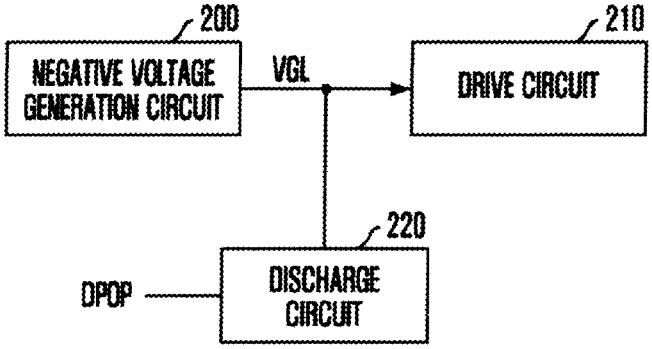
FIG. 4 is a block diagram of a display device including a discharge circuit in accordance with an embodiment of the present invention.

FIG. 4 is a block diagram of a display device including a discharge circuit in accordance with an embodiment of the present invention.

Referring to FIG. 4, the discharge circuit 220 in accordance with the embodiment of the present invention is used to discharge a negative voltage VGL to a ground voltage level in the display device including a drive circuit 210 which receives the negative voltage VGL in operation. For example, the drive circuit 210 may be a drive circuit of a display panel.

Figure 5:
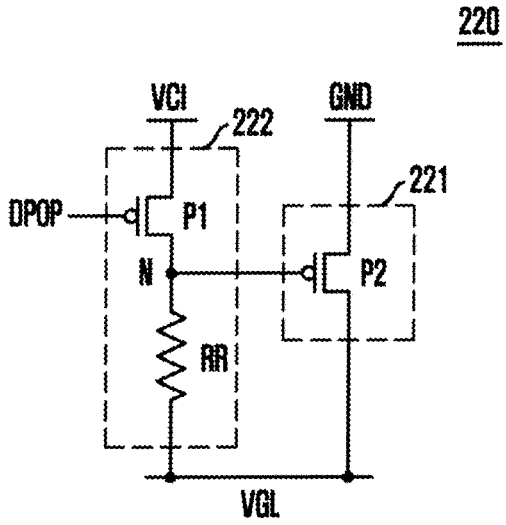
FIG. 5 is a circuit diagram of a discharge circuit in accordance with a first embodiment of the present invention.

FIG. 5 is a circuit diagram of a discharge circuit in accordance with a first embodiment of the present invention.

As illustrated in FIG. 5, the discharge circuit 220 includes a discharge unit 221 and a control unit 222. The discharge unit 221 is connected between a first input terminal receiving the negative voltage VGL and a second input terminal receiving a ground voltage GND, and discharges the negative voltage VGL to the ground voltage GND at the second input terminal in response to a control signal.

The control unit 222 is connected between the first input terminal and a third input terminal receiving an operation voltage VCI corresponding to a normal operation mode and an abnormal operation mode of the drive circuit 210, and generates the control signal in response to an operation signal DPOP for determining an operation state and a non-operation state in the normal operation mode of the drive circuit 210.

The control unit 222 includes a pull-up driver P1 and a pull-down driver RR. The pull-up driver P1 is connected between a node N and the third input terminal, and transfers the operation voltage VCI to the node N in response to the operation signal DPOP. The pull-down driver RR is connected between the node N and the first input terminal. For example, the pull-up driver P1 is configured with a p-channel transistor, and the pull-down driver RR is configured with a resistor.

The discharge unit 221 includes a p-channel transistor P2. The transistor P2 has a gate connected to the node N, a drain connected to the first input terminal, and a source connected to the second input terminal. The transistor P2 quickly discharges the negative voltage VGL, i.e., a gate off voltage, to the ground voltage GND at the second input terminal in response to the control signal outputted from the node N, thereby shifting the negative voltage VGL to the ground voltage level.

Figure 6:
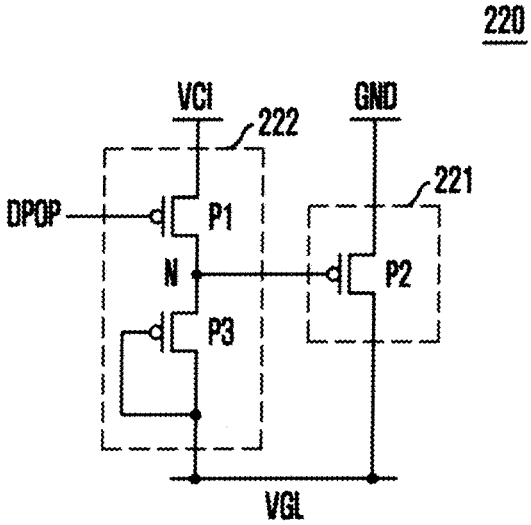
FIG. 6 is a circuit diagram of a discharge circuit in accordance with a second embodiment of the present invention.

The control unit 222 may be configured with a structure of FIG. 6.

FIG. 6 is a circuit diagram of a discharge circuit in accordance with a second embodiment of the present invention.

As illustrated in FIG. 6, the control unit 222 includes the pull-up driver P1 and a pull-down driver P3. The pull-up driver P1 is connected between the node N and the third input terminal, and transfers the operation voltage VCI to the node N in response to the operation signal DPOP. The pull-down driver P3 is connected between the node N and the first input terminal. Likewise the pull-up driver P1 is configured with a p-channel transistor. However, the pull-down driver P3 is configured with a diode-connected p-channel transistor. The pull-down driver P3 has a gate and a drain commonly connected to the first input terminal, and a source connected to the node N to thereby provide a diode-connected structure. Accordingly, the pull-down driver P3 serves as a resistor.

Since the discharge circuit 220 must operate at a relative high voltage, all the p-channel transistors of FIGS. 5 and 6 may be configured with high-voltage transistors.

Figure 7:
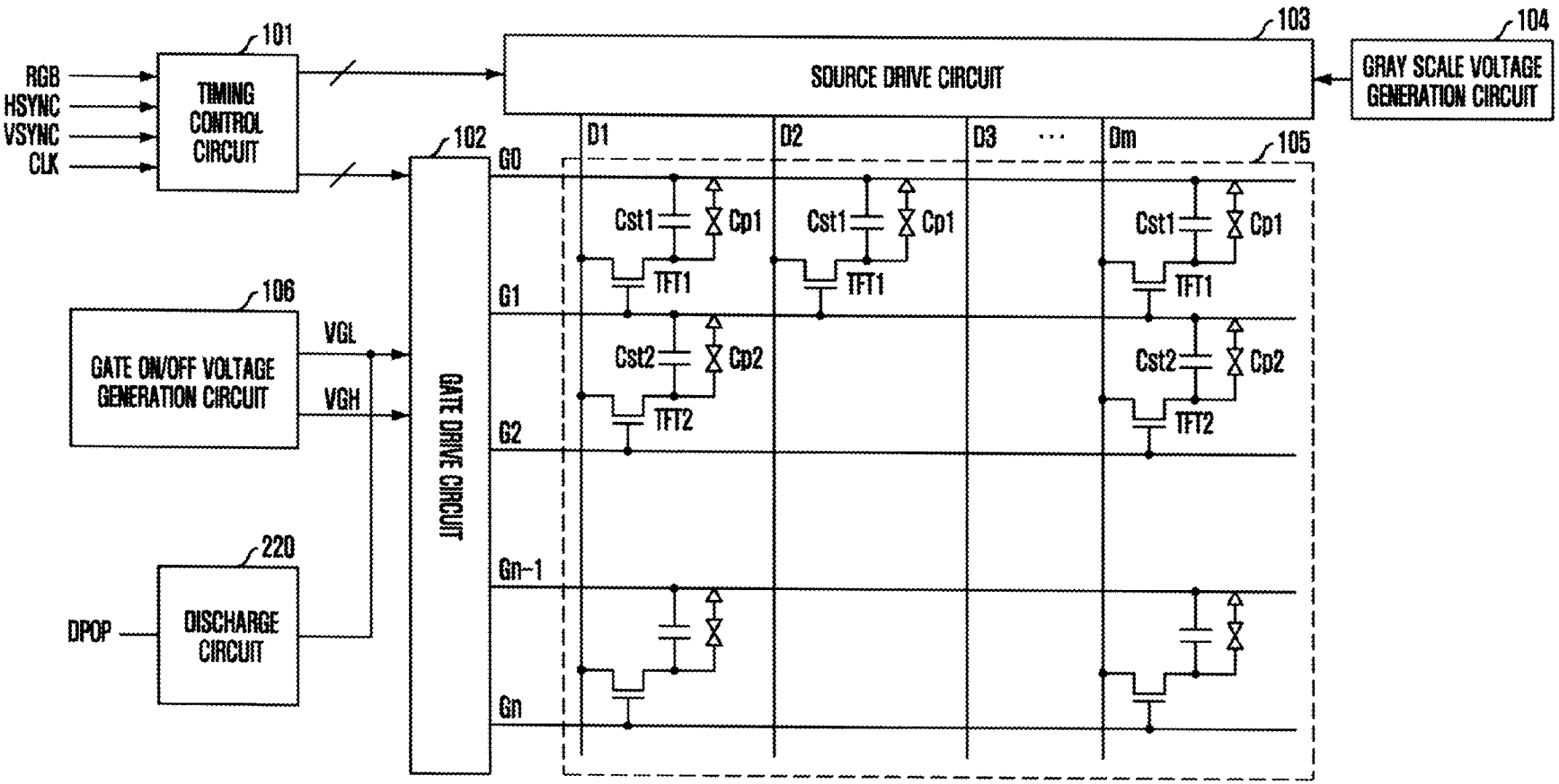
FIG. 7 is a block diagram of a LCD including a discharge circuit in accordance with an embodiment of the present invention.

FIG. 7 is a block diagram of a LCD including a discharge circuit in accordance with an embodiment of the present invention. For convenience, the LCD will be described below as an example of the display device.

Referring to FIG. 7, the LCD in accordance with the embodiment of the present invention includes a timing control circuit 101, a gate drive circuit 102, a source drive circuit 103, a gray scale voltage generation circuit 104, a liquid crystal panel 105, a gate on/off voltage generation circuit 106, and a discharge circuit 220.

Figure 1:
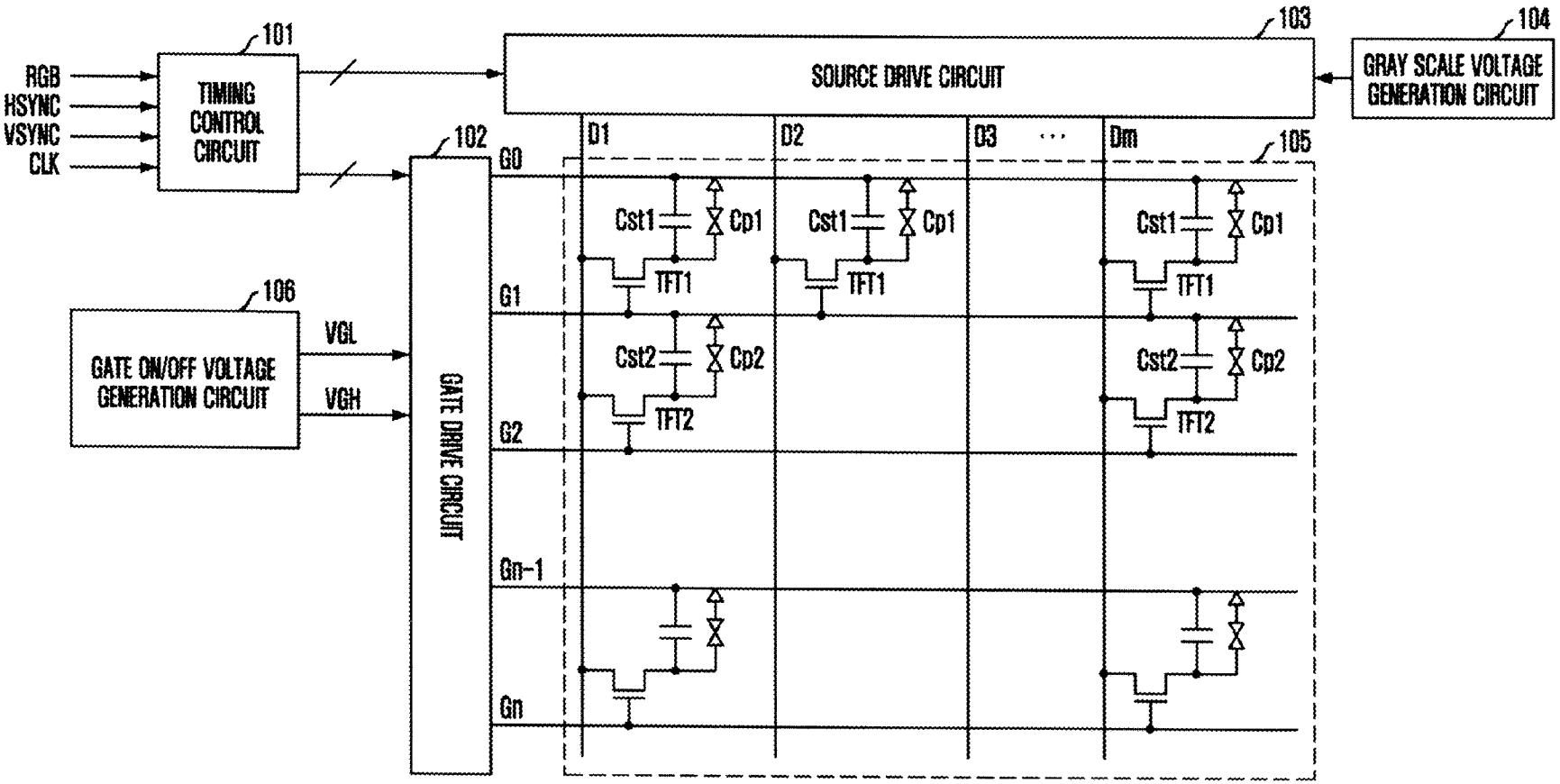
FIG. 1 (PRIOR ART)
FIG. 1 is a block diagram of a conventional liquid crystal display (LCD).

The LCD of FIG. 5 has the same configuration as that of the conventional LCD of FIG. 1, except for the discharge circuit 220 connected to the gate off voltage output terminal of the gate on/off voltage generation circuit 106. Accordingly, like reference numerals are used to refer to like elements throughout, and their duplicate description will be omitted.

Referring to FIGS. 5 and 6, the display device includes a liquid crystal panel 105, a gate on/off voltage generation circuit 106 generating gate on/off voltages to the liquid crystal panel 105, and a discharge circuit 220 discharging the gate off voltage VGL according to the operation mode of the liquid crystal panel 105. The discharge circuit 220 includes a discharge unit 221 and a control unit 222.

The discharge unit 221 is connected between a first input terminal receiving the gate off voltage VGL and a second input terminal receiving a ground voltage GND, and discharges the gate off voltage VGL to the ground voltage GND at the second input terminal in response to a control signal. The control unit 222 is connected between the first input terminal and a third input terminal receiving an operation voltage VCI corresponding to a normal operation mode and an abnormal operation mode of the liquid crystal panel 105, and generates the control signal in response to an operation signal DPOP for determining an operation state and a non-operation state in the normal operation mode of the liquid crystal panel 105.

Hereinafter, an operation of the discharge circuit 220 in accordance with the embodiment of the present invention will be described in connection with FIG. 8.

Normal Operation Mode

The normal operation mode is divided into the operation state and the non-operation state (including a standby mode) according to a state of the liquid crystal panel 105 controlled by the drive circuit, for example, the gate drive circuit 102. The operation state refers to a state where the drive circuit normally operates by the smooth providing of the power supply voltage so that the liquid crystal panel 105 operates. The non-operation state refers to a state where a user normally stops the drive circuit by manipulating a power switch and thus the liquid crystal panel 105 does not operate.

Figure 8A:
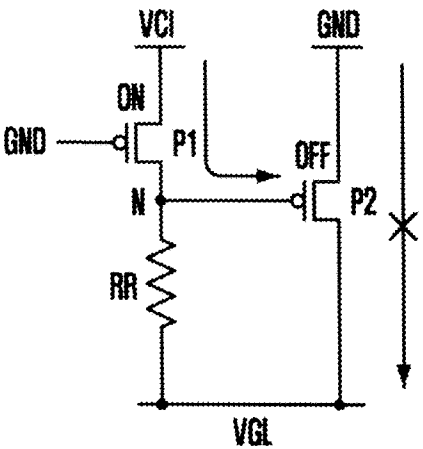
FIGS. 8A to 8C are circuit diagrams illustrating the operation characteristics of the discharge circuit in accordance with the embodiment of the present invention.

FIG. 8A is a circuit diagram illustrating the operation of the discharge circuit in accordance with embodiments of the present invention when the liquid crystal panel is in an operation state in the normal operation mode. Referring to FIG. 8A, when the liquid crystal panel 105 is in the operation state, the operation signal DPOP has the ground voltage level. Accordingly, the transistor P1 is turned on, and consequently the operation voltage VCI of a power supply voltage is applied to the node N through the third input terminal so that the transistor P2 is turned off. Therefore, the current path between the first and second input terminals is broken, and thus the gate off voltage VGL maintains its level without being discharged to the second input terminal.

Figure 8B:
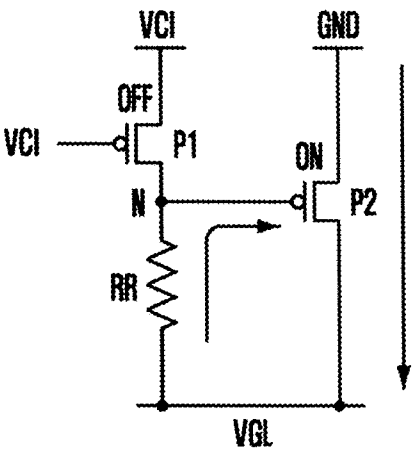

FIG. 8B is a circuit diagram illustrating the operation of the discharge circuit in accordance with embodiments of the present invention when the liquid crystal panel is in the non-operation state in the normal operation mode. Referring to FIG. 8B, when the liquid crystal panel 105 is in the non-operation state, the operation signal DPOP has the power supply voltage level. Accordingly, the transistor P1 is turned off, and the gate off voltage VGL is applied to the node N by the pull-down driver RR. Consequently, the transistor P2 is turned on. Accordingly, the current path is provided between the first and second input terminals so that the gate off voltage VGL is discharged to the ground voltage GND at the second input terminal.

Abnormal Operation Mode

The abnormal operation mode denotes that the drive circuit is stopped since the external power supply voltage is abnormally shut off due to an external impulse or a power failure, in the normal operation mode of the liquid crystal panel 105 controlled by the drive circuit 210 or the gate drive circuit 102 being the drive circuit.

Figure 8C:
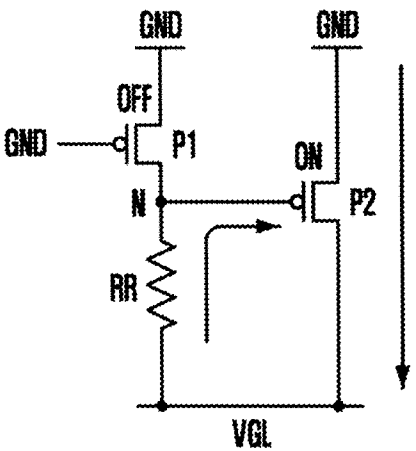

FIG. 8C is a circuit diagram illustrating the operation of the discharge circuit in accordance with embodiments of the present invention when the liquid crystal panel is in the operation state in the abnormal operation mode. Referring to FIG. 8C, when the liquid crystal panel 105 is in the operation state, the operation signal DPOP has the ground voltage level. At this point, the external power supply voltage is shut off and thus the third input terminal receives the ground voltage instead of the power supply voltage.

Accordingly, the transistor P1 maintains a turn-on state and then is turned off at a time when the ground voltage is applied by the shut-off of the power supply voltage. Consequently, the gate off voltage VGL is applied to the node N by the pull-down resistor R so that the transistor P2 is turned on. Accordingly, the current path is provided between the first and second input terminals, and thus the gate off voltage VGL is discharged to the ground voltage GND at the second input terminal.

As illustrated in FIG. 8, when the liquid crystal panel 105 is in the non-operation state in the normal operation mode and enters the abnormal operation mode from the normal operation mode, the discharge circuit in accordance with embodiments of the present invention quickly discharges the gate off voltage VGL to the second input terminal through the transistor P2.

Figure 2:
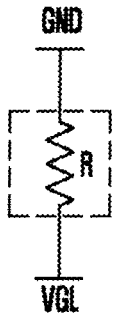
FIG. 2 (PRIOR ART)
FIG. 2 is a circuit diagram of a conventional discharge circuit.
Figure 3:
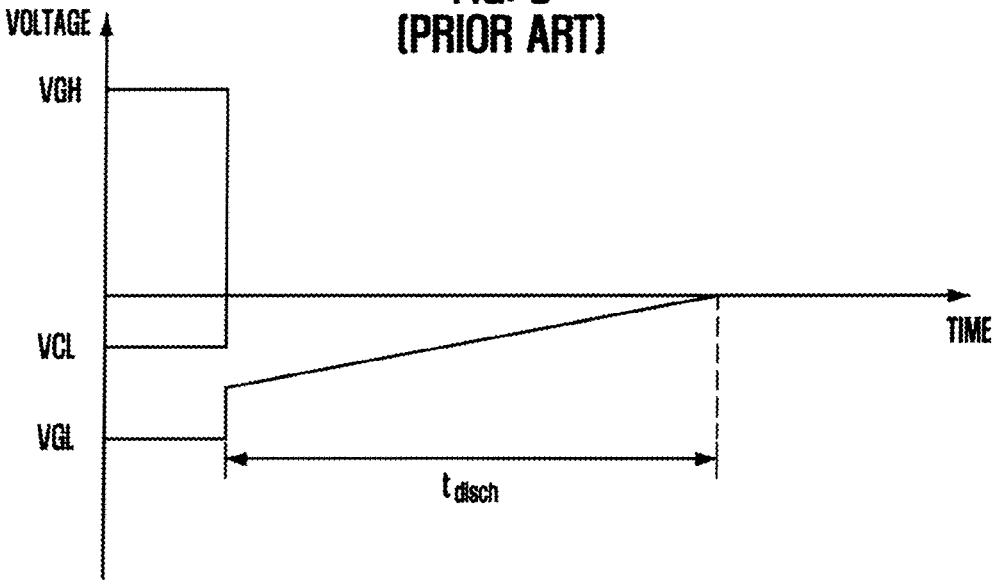
FIG. 3 (PRIOR ART)
FIG. 3 is an exemplary diagram for explaining the characteristics of the conventional discharge circuit.
Figure 9:
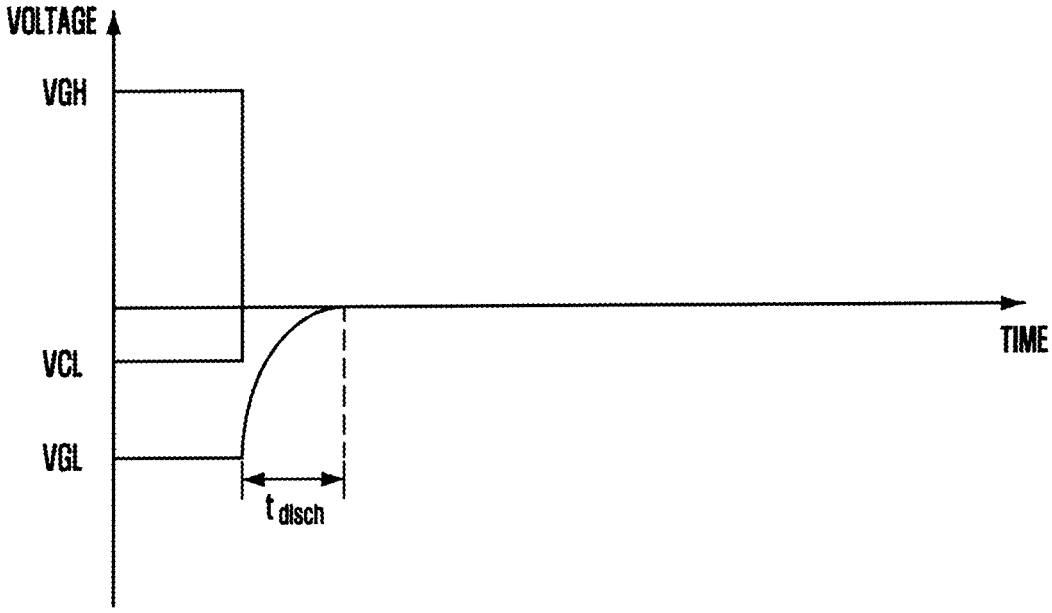
FIG. 9 is an exemplary diagram for describing the characteristics of the discharge circuit in accordance with embodiments of the present invention.

FIG. 3 is a graph illustrating a gate on/off voltage which is measured in the conventional drive circuit when the discharge circuit configured with only the resistor of FIG. 2 is applied. FIG. 9 is a graph illustrating a gate on/off voltage which is measured in the drive circuit when the discharge circuit in accordance with the embodiment of the present invention is applied. In FIGS. 3 and 9, a reference 'VCL' represents a common electrode voltage.

In the conventional technology, it can be seen from FIG. 3 that the gate off voltage VGL is gradually discharged in the abnormal operation mode, i.e., when a module is abnormally stopped (the external power supply voltage is shut off and thus the drive circuit is stopped). On the other hand, it can be seen from FIG. 9 that the discharge circuit in accordance with the embodiment of the present invention discharges the gate off voltage VGL more quickly than the conventional discharge circuit.

As described above, embodiments of the present invention configure the discharge circuit as illustrated in FIGS. 5 and 6. Accordingly, the discharge circuit in accordance with the embodiments of the present invention prevents the leakage current from flowing to the second input terminal (the ground voltage terminal) from the gate off voltage VGL when the drive circuit of the liquid crystal panel normally operates, and quickly discharges the gate off voltage VGL of the liquid crystal panel to the second input terminal when the drive circuit is stopped by the shut-off of the external power supply voltage VCI, thereby removing image sticking occurring in the liquid crystal panel.

Embodiments of the present invention can prevent the leakage current between the first and second input terminals by breaking the current path between the first input terminal receiving the gate off voltage (a negative voltage) and the second input terminal receiving the ground voltage when the drive circuit of the liquid crystal panel operates normally, and quickly discharge the gate off voltage to the second input terminal by providing the current path between the first and second input terminals when the external power supply voltage is shut off so that the drive circuit of the liquid crystal panel is stopped, thereby removing image sticking occurring in the liquid crystal panel.

While the present invention has been described with respect to the specific embodiments, it will be apparent to those skilled in the art that various changes and modifications may be made without departing from the spirit and scope of the invention as defined in the following claims. Moreover, in embodiments of the present invention, the drive circuit controlling the liquid crystal panel has been described as an example of the drive circuit of the display panel, but these embodiments are for convenience and can be applied to a semiconductor circuit (device) which must quickly discharge a negative voltage in operation after receiving the negative voltage to thereby operate.

What is claimed is:

1. A discharge circuit of a device including a drive circuit operating based on an inputted negative voltage, the discharge circuit comprising:

a discharge unit connected between a first input terminal receiving the negative voltage and a second input terminal receiving a ground voltage, and configured to discharge the negative voltage to the ground voltage of the second input terminal in response to a control signal; and a control unit connected between the first input terminal and a third input terminal receiving an operation voltage corresponding to a normal operation mode and an abnormal operation mode of the drive circuit, and configured to generate the control signal in response to an operation signal for determining an operation state and a non-operation state in the normal operation mode of the drive circuit.

2. The discharge circuit of claim 1, wherein the control unit comprises: a pull-up driver connected between a node and the third input terminal, and configured to transfer the operation voltage to the node in response to the operation signal; and a pull-down driver connected between the node and the first input terminal.

3. The discharge circuit of claim 2, wherein the pull-up driver comprises a p-channel transistor.

4. The discharge circuit of claim 2, wherein the pull-down driver comprises a resistor.

5. The discharge circuit of claim 2, wherein the pull-down driver comprises a diode-connected p-channel transistor.

6. The discharge circuit of claim 1, wherein the discharge unit comprises a p-channel transistor.

7. The discharge circuit of claim 1, wherein the operation voltage has a power supply voltage level in the normal operation mode of the drive circuit, and has a ground voltage level in the abnormal operation mode of the drive circuit.

8. The discharge circuit of claim 1, wherein the operation signal has a ground voltage level when the drive circuit is in the operation state, and has a power supply voltage level when the drive circuit is in the non-operation state.

9. A display device, comprising:

a display panel;

a gate on/off voltage generation circuit configured to output a gate on voltage and a gate off voltage to the display panel; and a discharge circuit configured to discharge the gate off voltage according to an operation mode of the display panel, wherein the discharge circuit comprises:

a discharge unit connected between a first input terminal receiving the gate off voltage and a second input terminal receiving a ground voltage, and configured to discharge the gate off voltage to the ground voltage of the second input terminal in response to a control signal; and a control unit connected between the first input terminal and a third input terminal receiving an operation voltage corresponding to a normal operation mode and an abnormal operation mode of the display panel, and configured to generate the control signal in response to an operation signal for determining an operation state and a non-operation state in the normal operation mode of the display panel.

10. The display device of claim 9, wherein the control unit comprises: a pull-up driver connected between a node and the third input terminal, and configured to transfer the operation voltage to the node in response to the operation signal; and a pull-down driver connected between the node and the first input terminal.

11. The display device of claim 10, wherein the pull-up driver comprises a p-channel transistor.

12. The display device of claim 10, wherein the pull-down driver comprises a resistor.

13. The display device of claim 10, wherein the pull-down driver comprises a diode-connected p-channel transistor.

14. The display device of claim 9, wherein the discharge unit comprises a p-channel transistor.

15. The display device of claim 9, wherein the operation voltage has a power supply voltage level in the normal operation mode of the display panel, and has a ground voltage level in the abnormal operation mode of the display panel.

16. The display device of claim 9, wherein the operation signal has a ground voltage level when the display panel is in the operation state, and has a power supply voltage level when the display panel is in the non-operation state.

17. The display device of claim 9, wherein the gate off voltage is a negative voltage.

18. The display device of claim 9, wherein the display panel is a liquid crystal display.

* * * * *